US010176656B2

(12) United States Patent
Gengler et al.

(10) Patent No.: US 10,176,656 B2
(45) Date of Patent: Jan. 8, 2019

(54) WIRELESS LOCKING DEVICE

(71) Applicant: NOKE, INC., Lehi, UT (US)

(72) Inventors: David P. Gengler, Draper, UT (US); Arthur Healey, Centerville, UT (US); Cameron Gibbs, Draper, UT (US)

(73) Assignee: NOKE, INC., Lehi, UT (US)

( * ) Notice: Subject to any disclaimer, the term of this patent is extended or adjusted under 35 U.S.C. 154(b) by 0 days.

(21) Appl. No.: 15/669,807

(22) Filed: Aug. 4, 2017

(65) Prior Publication Data

US 2018/0018843 A1 Jan. 18, 2018

Related U.S. Application Data

(63) Continuation of application No. 14/610,578, filed on Jan. 30, 2015, now Pat. No. 9,747,739.

(60) Provisional application No. 62/038,774, filed on Aug. 18, 2014.

(51) Int. Cl.

| | |
|---|---|
| ***G07C 9/00*** | (2006.01) |
| ***E05B 47/00*** | (2006.01) |
| ***E05B 67/00*** | (2006.01) |

(52) U.S. Cl.

CPC ..... *G07C 9/00571* (2013.01); *E05B 67/00* (2013.01); *E05B 2047/0095* (2013.01); *G07C 2009/00746* (2013.01)

(58) Field of Classification Search

None

See application file for complete search history.

(56) References Cited

U.S. PATENT DOCUMENTS

| | | | | |
|---|---|---|---|---|
| 1,882,794 A | | 10/1932 | Full | |
| 2,049,416 A | | 8/1936 | Aldeen | |
| 3,838,395 A | * | 9/1974 | Suttill, Jr. | E05B 49/006 340/5.5 |

(Continued)

FOREIGN PATENT DOCUMENTS

| | | |
|---|---|---|
| CN | 204002132 | 12/2014 |
| EP | 2607582 | 6/2013 |

(Continued)

OTHER PUBLICATIONS

Activekey, "ActiveKEY User Manual", http://www.supraekey.com/Documents/ActiveKEY_user_manual.pdf, Feb. 2013.

(Continued)

*Primary Examiner* — Chico A Foxx

(74) *Attorney, Agent, or Firm* — Phillips, Ryther & Winchester; Justin Flanagan

(57) ABSTRACT

An electronic locking device can be configured to become active from a low power state, receive physical input to unlock, and provide access to a replaceable power supply. An electronic locking device can use a combination of physical input and discovery of an authorized mobile device to enable transition from a locked state to an unlocked state. Authorization can be internally stored or externally obtained through a service. An electronic locking device can match a series of physical interactions to a series of stored interactions to enable transition from a locked state to an unlocked state, when an authorized device is unavailable. An electronic locking device can provide access to a replaceable power supply when a latch is released.

5 Claims, 9 Drawing Sheets

(56) References Cited

U.S. PATENT DOCUMENTS 4,499,462 A * 2/1985 Stoesser ..... G07C 9/00682 340/12.17
5,646,605 A 7/1997 Leonaggeo
6,411,195 B1 * 6/2002 Goldman ..... G07C 9/00182 340/407.1
6,442,983 B1 9/2002 Thomas
6,505,774 B1 * 1/2003 Fulcher ..... G06Q 30/0284 235/379
6,898,952 B1 5/2005 Lin
6,989,732 B2 1/2006 Fisher
7,021,092 B2 * 4/2006 Loughlin ..... E05B 67/38 70/25
7,236,085 B1 6/2007 Aronson
7,423,515 B1 9/2008 Fiske
8,274,365 B2 7/2012 Piccirillo
8,477,011 B2 7/2013 Tubb
8,791,790 B2 7/2014 Robertson
8,850,858 B2 10/2014 Nave
8,875,550 B1 11/2014 Spunt
8,881,558 B2 * 11/2014 Misner ..... E05B 35/105 70/21
8,919,024 B2 12/2014 Milde
8,922,333 B1 12/2014 Kirkjan
9,057,210 B2 6/2015 Dumas
9,077,716 B2 7/2015 Myers
9,109,379 B1 8/2015 Ranchod
9,115,511 B1 8/2015 Schmidt
9,121,199 B2 9/2015 Li
9,437,062 B2 9/2016 Ahearn
9,495,820 B1 11/2016 Li
9,728,022 B2 8/2017 Gengler
9,747,739 B2 8/2017 Gengler
2002/0088256 A1 7/2002 Taylor
2003/0011719 A1 * 1/2003 Jang ..... G09G 5/363 348/790
2003/0016847 A1 1/2003 Quintana
2004/0064309 A1 * 4/2004 Kosai ..... G10L 19/24 704/211
2004/0108938 A1 6/2004 Entrekin
2005/0099262 A1 5/2005 Childress
2005/0201076 A1 9/2005 Marcelle
2005/0210283 A1 9/2005 Kato
2005/0213441 A1 9/2005 Voltz
2006/0061549 A1 6/2006 Chen
2006/0179903 A1 8/2006 Goldman
2006/0283216 A1 12/2006 Marcelle
2006/0288744 A1 12/2006 Smith
2007/0017977 A1 1/2007 Ueda
2007/0126551 A1 6/2007 Slevin
2007/0132552 A1 6/2007 Kurpinski
2007/0216764 A1 9/2007 Kwak
2007/0229257 A1 10/2007 Bliding
2008/0024272 A1 * 1/2008 Fiske ..... E05B 47/0002 340/5.83
2008/0047783 A1 * 2/2008 Vogl ..... B66B 5/005 187/314
2008/0068128 A1 3/2008 Ghabra
2008/0100417 A1 5/2008 Hata
2008/0118014 A1 5/2008 Reunamaki
2008/0129473 A1 * 6/2008 Tsuruta ..... B60R 25/04 340/426.13
2008/0136587 A1 6/2008 Orr
2008/0215841 A1 * 9/2008 Bolotin ..... G06F 1/1632 711/164
2008/0230086 A1 * 9/2008 Murphy ..... A45D 40/06 132/320
2008/0252415 A1 10/2008 Larson
2009/0153291 A1 6/2009 Larson
2009/0189747 A1 * 7/2009 Baier ..... F24C 7/082 340/407.1
2009/0256676 A1 10/2009 Piccirillo
2009/0261945 A1 10/2009 Ko
2009/0312051 A1 * 12/2009 Hansson ..... G06F 1/1626 455/556.1
2010/0053861 A1 * 3/2010 Kim ..... H04M 1/22 361/679.01
2010/0073129 A1 3/2010 Pukari
2010/0083713 A1 4/2010 Woodling
2010/0158327 A1 6/2010 Kangas
2010/0166207 A1 * 7/2010 Masuyama ..... H04R 1/1041 381/74
2010/0222940 A1 9/2010 Putsch
2010/0245289 A1 * 9/2010 Svajda ..... G06F 3/0421 345/175
2010/0306718 A1 * 12/2010 Shim ..... G06F 3/04883 715/863
2011/0001603 A1 1/2011 Willis
2011/0090047 A1 4/2011 Patel
2011/0259063 A1 * 10/2011 Foti ..... E05B 45/005 70/344
2012/0011902 A1 1/2012 Meekma
2012/0186308 A1 7/2012 Garthe
2012/0229251 A1 9/2012 Ufkes
2012/0280783 A1 11/2012 Gerhardt
2012/0306748 A1 * 12/2012 Fleizach ..... G06F 3/033 345/161
2012/0312956 A1 * 12/2012 Chang ..... G06F 3/017 250/201.1
2012/0324967 A1 12/2012 Goren
2012/0324968 A1 12/2012 Goren
2013/0021273 A1 1/2013 Lee
2013/0055773 A1 * 3/2013 Li ..... E05B 47/06 70/278.1
2013/0076206 A1 * 3/2013 Rosenberg ..... G06F 3/016 310/319
2013/0099893 A1 4/2013 Kulinets
2013/0110264 A1 5/2013 Weast
2013/0118216 A1 * 5/2013 Kalous ..... G07C 9/00944 70/24
2013/0127706 A1 * 5/2013 Hsu ..... H04M 1/67 345/156
2013/0169549 A1 * 7/2013 Seymour ..... G06F 3/0488 345/173
2013/0203348 A1 8/2013 Lim
2013/0257590 A1 10/2013 Kuenzi
2013/0257716 A1 10/2013 Xin
2013/0293368 A1 * 11/2013 Ottah ..... G08B 23/00 340/426.1
2013/0332848 A1 * 12/2013 Lam ..... G06F 3/017 715/751
2013/0335193 A1 12/2013 Hanson
2013/0342314 A1 12/2013 Chen
2014/0015737 A1 * 1/2014 Inoue ..... H04M 1/7253 345/2.3
2014/0028443 A1 1/2014 Ebner
2014/0056033 A1 * 2/2014 Woo ..... H02M 3/33507 363/21.01
2014/0077929 A1 3/2014 Dumas
2014/0109631 A1 4/2014 Asquith
2014/0113563 A1 4/2014 Almonani
2014/0150502 A1 6/2014 Duncan
2014/0195841 A1 * 7/2014 Lee ..... G06F 1/3206 713/323
2014/0210592 A1 7/2014 Van Wiemeersch
2014/0218167 A1 8/2014 Tseng
2014/0250954 A1 9/2014 Buzhardt
2014/0260452 A1 9/2014 Chen
2014/0265359 A1 9/2014 Cheng
2014/0266588 A1 9/2014 Majzoobi
2014/0292481 A1 10/2014 Dumas
2014/0310653 A1 * 10/2014 Han ..... G06F 3/0482 715/810
2014/0326027 A1 11/2014 Avganim
2014/0360232 A1 12/2014 Al-Kahwati
2014/0375422 A1 12/2014 Huber
2015/0076989 A1 * 3/2015 Walma ..... H04B 10/40 315/149
2015/0102902 A1 4/2015 Chen
2015/0120151 A1 4/2015 Akay
2015/0143260 A1 * 5/2015 Bailey ..... G06Q 50/01 715/753

(56) References Cited

U.S. PATENT DOCUMENTS

| | | | | |
|---|---|---|---|---|
| 2015/0168099 | A1 | 6/2015 | Hyde | |
| 2015/0170447 | A1 | 6/2015 | Buzhardt | |
| 2015/0178532 | A1* | 6/2015 | Brule | G06K 19/0717 340/5.61 |
| 2015/0220918 | A1* | 8/2015 | Davis | G06F 21/32 705/44 |
| 2015/0225986 | A1 | 8/2015 | Goldman | |
| 2015/0240531 | A1 | 8/2015 | Blust | |
| 2015/0278124 | A1* | 10/2015 | Bolotin | G06F 1/1632 726/17 |
| 2015/0292244 | A1 | 10/2015 | Beatty | |
| 2016/0002953 | A1 | 1/2016 | Sada | |
| 2016/0035163 | A1* | 2/2016 | Conrad | G07C 9/00309 340/5.61 |
| 2016/0042582 | A1 | 2/2016 | Hyde | |
| 2016/0047142 | A1 | 2/2016 | Gengler | |
| 2016/0142093 | A1* | 5/2016 | Phang | H04B 1/3888 455/575.8 |
| 2016/0217637 | A1* | 7/2016 | Gengler | G07C 9/00174 |
| 2016/0299680 | A1* | 10/2016 | Polyulya | G06F 3/0488 |
| 2016/0330244 | A1* | 11/2016 | Denton | G06F 17/30194 |

FOREIGN PATENT DOCUMENTS

| | | |
|---|---|---|
| WO | WO2007020574 | 2/2007 |
| WO | WO2013170292 | 11/2013 |
| WO | WO2013189721 | 12/2013 |

OTHER PUBLICATIONS

AMADAS, "AMADAS Smart Lock: The Truly UserCentric", Per KickStarter Jul. 2014 Idea & design; Protoype in Jan. 2015; (not availableon Wayback Machine) https://www.kickstarter.com/projects/2033716885/amadas-smart-lockthe-truly-user-centricsecurity? ref=nav_search, Jul. 31, 2014.

Bitlock, "Toss your bike key with BitLock Bluetooth lock", https://www.cnet.com/news/toss-your-bike-key-with-bitlock-bluetoothlock/, Oct. 15, 2013.

Ha, "Are Smart Locks Secure, or Just Dumb?", http://gizmodo.com/aresmart-locks-secure-or-just-dumb-511093690, Mar. 5, 2013.

Lockitron, "Lockitron turns your smartphone into a house key", http://newatlas.com/lockitron-turns-yoursmartphone-into-a-housekey/24422/, Oct. 4, 2012.

Padlock Evolution, "The padlock evolution", From ProQuest, Apr. 1999.

PR100, "PR100", http://www.assaabloyamericasuniversity.com/Other/AssaAbloyAmericasUniv/Lesson%20Resources/SARAperioHowToOrder/PR100%20Catalog%20For%20Training.pdf, 2012.

Ritchie et al, "The future of authentication: Biometrics, multi-factor, and co-dependency", http://web.archive.org/web/20131210115341/http://www.androidcentral.com/talk-mobile/future-authentication-biometrics-multi-factor-and-codependency-talk-mobile, Dec. 10, 2013.

Saluki, "Project Proposal Generic Wireless Lock",http://www.engr.siu.edu/ugrad/me495a/S13-GLCK/Documentation/[495]%20Proposal%20s13_44_GLCK_2nd.pdf, May 2, 2013.

Sharekey, "ShareKey smartphone app replaces your house keys", http://newatlas.com/sharekey-smartphone-nfc-house-keys/25653/, Jan. 6, 2013.

Skylock, "Meet Skylock", http://web.archive.org/web/20140712040738/https://skylock.cc, Jul. 12, 2004.

Skylock2, "Skylock bike lock uses the power of the sun to thwart thieves and connect to riders", http://newatlas.com/skylock-solarpowered-bike-lock/32157/, May 20, 2014.

Supraekey, "Real-Time Wireless Key Management", http://www.supraekey.com/Documents/Realtime_Wireless.pdf, 2010.

Teo, "Teo Bluetooth Padlock lets you secure school lockers, chains & gates with Apple's iPhone", http://appleinsider.com/articles/14/01/11/teobluetooth- padlock-lets-you-secure-school-lockers-chains-gates-withapples-iphone, Jan. 11, 2014.

Todorovic, "Lockbox realtor's dream", From ProQuest, Sep. 17, 2005.

Unikey, "UniKey replaces physical door lock key with an app", http://newatlas.com/unikey-door-lock-app/22635/, May 22, 2012.

Paoli, "Betty Brachman's connections", From Proquest, Oct. 8, 2000.

Woollaston, "The smart lock that lets you open your front door using just your phone—and can even let in guests when you're not home", http://www.dailymail.co.uk/sciencetech/article-2333375/The-smart-locklets-open-door-using-just-phone--let-guests-youre-home.html, May 30, 2013.

Youtube, "2 Factor Authentication Lock", https://www.youtube.com/watch?v=qm7NaEbcoLA, Dec. 3, 2013.

PCT International Search Report; International App. No. PCT/US2015/045541; dated Jan. 12, 2016.

USPTO Notice of Allowance; U.S. Appl. No. 14/610,578; dated Jun. 16, 2017.

USPTO Non-final Office Action; U.S. Appl. No. 14/610,578; dated Dec. 14, 2016.

USPTO Non-final Office Action; U.S. Appl. No. 14/610,578; dated Apr. 15, 2016.

USPTO Non-final Office Action; U.S. Appl. No. 14/610,578; dated Apr. 8, 2015.

USPTO Final Office Action; U.S. Appl. No. 14/610,578; dated Nov. 19, 2015.

USPTO Final Office Action; U.S. Appl. No. 14/610,578; dated Jul. 29, 2016.

USPTO Non-final Office Action; U.S. Appl. No. 15/009,640; dated Dec. 22, 2016.

USPTO Notice of Allowance; U.S. Appl. No. 15/009,640; dated Jun. 15, 2017.

U.S. Appl. No. 15/669,811, Non-Final Office Action dated Dec. 29, 2017.

* cited by examiner

WIRELESS LOCKING DEVICE

TECHNICAL FIELD

The present disclosure relates to locking devices and more specifically to locking devices configured to communicate over wireless channels.

DETAILED DESCRIPTION OF PREFERRED EMBODIMENTS

A detailed description of systems and methods consistent with embodiments of the present disclosure is provided below. While several embodiments are described, it should be understood that the disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

Techniques, apparatus, and methods are disclosed that enable an electronic locking device to become active from a low power state (such as a sleep state or a zero power state), receive physical input to unlock (such as through a physical interface), and provide access to a replaceable power supply. In a first embodiment, an electronic locking device can use a combination of physical input and discovery of an authorized mobile device to enable transition from a locked state to an unlocked state. The electronic locking device can receive a physical input, causing the electronic locking device to transition from a low power state to an active state. The electronic locking device can determine if a wireless device is present. If a wireless device is present, the electronic locking device can determine whether the wireless device is authorized to unlock the electronic locking device.

If the wireless device is authorized, the electronic locking device can transition to an unlocked state.

Figure 2:
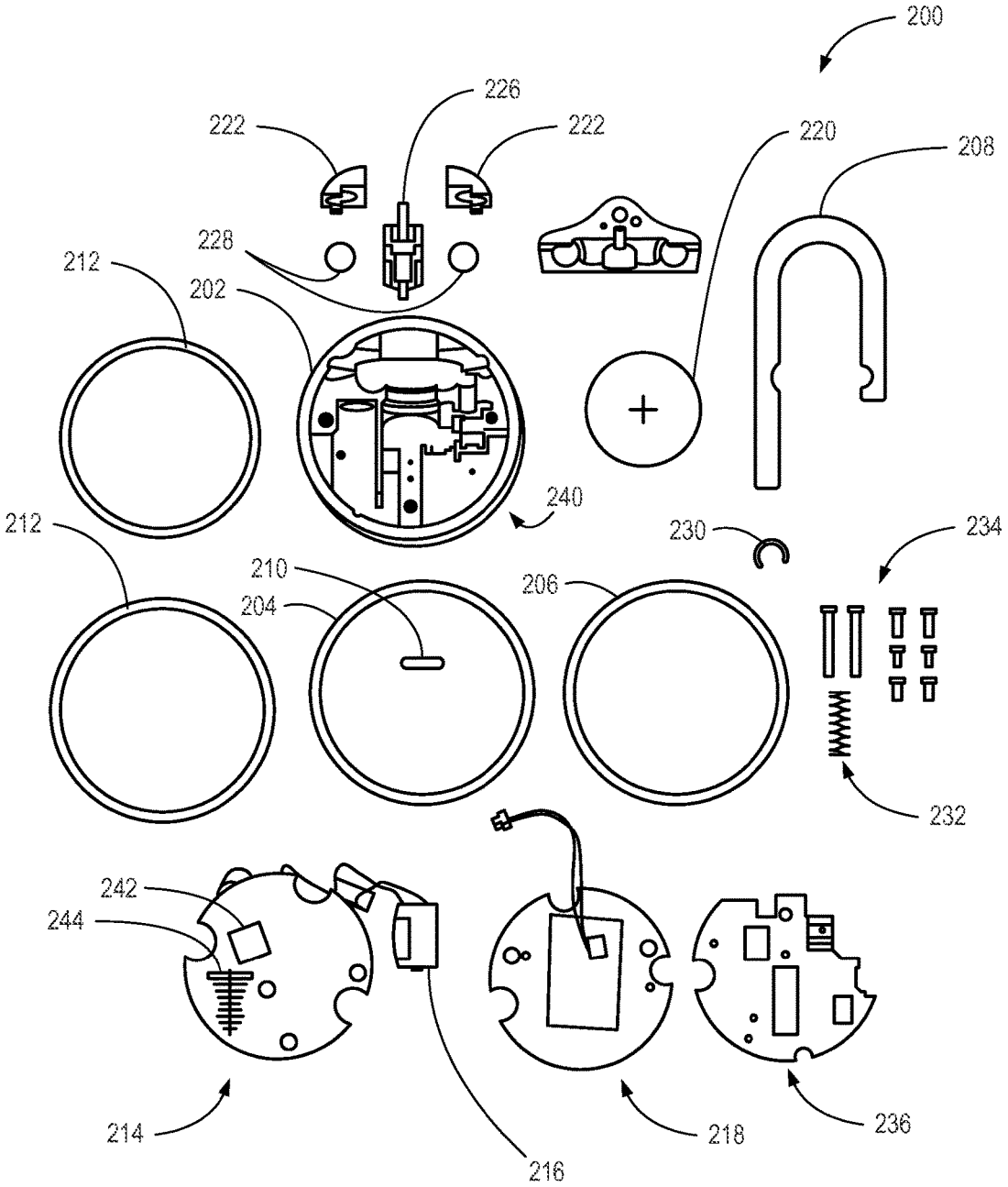
FIG. 2 is an exploded diagram illustrating the electronic locking device of FIG. 1 consistent with embodiments disclosed herein.

For example, an electronic lock can be placed on a locker. A user pushes on a u-bend at the top of the electronic lock and on a bottom of a cylinder of the lock, causing the u-bend to move toward the cylinder of the lock. The movement of the u-bend can cause an end of the u-bend to contact an electronic switch. The switch can provide a signal that causes a processor in the electronic lock to transition from a sleep state to an awake state. The processor can cause a Bluetooth™ low power beacon to be transmitted. A smartphone configured with an application to access a lock service can respond to the beacon. As part of the response and/or negotiation, the smartphone can provide an authorization payload (e.g., a token, key, and/or code) proving authorization to access the electronic lock. Upon verifying the authorization (e.g., by pre-configuration or contacting a service over a second communication channel), the electronic lock can transition from a locked state to an unlocked state and release a locking mechanism (e.g., as shown in FIG. 2). In one example, the lock can be re-engaged by resetting the u-bend into the cylinder of the lock and pressing the u-bend into the cylinder. The pressing of the u-bend can cause the switch to activate and the lock to transition from an unlocked state to a locked state and lock the locking mechanism.

In some embodiments, the electronic lock does not require physical input. The electronic lock can send out a beacon over a long duration interval to conserve battery power (e.g., one-second intervals). A mobile device can respond to the beacon and prove authorization to access the electronic lock. Upon confirmation of the authorization, the electronic lock can transition from a locked state to an unlocked state and release a locking mechanism.

In a second embodiment, an electronic locking device can match a series of long and/or short physical interactions to a series of stored interactions to enable the transition from a locked state to an unlocked state. The electronic locking device can detect a first physical interaction that causes it to transition from a low power state to an active state. In some embodiments, an indicator (such as an LED light or sound) can indicate the transition is complete. A user can then interact with the locking device through a series of long and/or short physical input interactions. When a series of physical input actions matches a stored set of input actions, the electronic locking device can transition from a locked state to an unlocked state and release a locking mechanism.

For example, an electronic padlock can be placed on a hasp to secure a shed door. A user can touch a capacitive touch sensing front panel to cause the electronic padlock to wake from a sleep state. The electronic padlock can flash a green light and/or sound a short beep to indicate the lock is ready for input. Having set a stored code of long touches and short touches beforehand (such as through an application on a smartphone or a locking service), a user can repeat the code to the lock by touching the capacitive touch sensing front panel. If the input code matches the stored code, the lock can transition from a locked state to an unlocked state and release a captured shackle (also known as a shank). When a user determines that the electronic padlock should be locked again, the user can replace the shackle and touch the touch sensing front panel to cause the electronic padlock to transition to a locked state from an unlocked state and recapture the shackle.

Various sensors can be used to provide input to the electronic locking device alone or in combination through a physical interface. Physical inputs can include use of accelerometers (e.g., activated by shaking and/or movement of a lock), light sensors (e.g., activated by waving a hand between a light source and/or the lock), infrared sensors (e.g., activated by waving a hand in front of the lock), front buttons (e.g., activated by pushing on a front of the lock body), shank buttons (e.g., activated by pushing the shank into the lock body), switches (e.g., activated by pushing a spring-loaded switch to a second position that returns to a first position), capacitive touch sensors (e.g., activated by touching a panel and/or lock body), resistive touch sensors (e.g., activated by pressing on a panel), light-based touch sensors (e.g., activated by breaking a beam across the lock body), etc. A combination of sensors also can be used. In one embodiment, a light sensor is used in combination with an accelerometer. The lock can remain in a low power state until both the light sensor detects a change in light and the accelerometer detects shaking of the device. This combination can help preserve battery power, such as on occasions when a lock is in a backpack. A sole accelerometer input might cause the lock to wake up when the backpack is jostled during walking or riding a bike. With both sensors, however, the light may remain dim while in the backpack, causing the lock to remain in a low power state. Electronic inputs can include use of wireless local area network interface (also known as WiFi™), Bluetooth™, ZigBee™, ethernet, USB™, Long Term Evolution (LTE™), near field communication (NFC), etc.

In some embodiments, the electronic padlock can first attempt to connect to an authorized electronic device. For example, after receiving the input from a capacitive touch sensor, the electronic padlock can transmit one or more Bluetooth™ beacons indicating the lock is awake. After receiving no response, the electronic padlock can then indicate to a user that it is available for physical input attempts by lighting the green light and/or sounding the short beep. In one embodiment, the lock can continue to send out Bluetooth™ beacons. In other embodiments, the electronic padlock may use an indicator and a user must wait a set amount of time (such as one second) before the padlock is ready to receive input.

In some embodiments, the electronic padlock can be reset so that another code can be attempted. In an embodiment, if an input code is incorrectly input, the lock will reset if no activity is sensed for two seconds. In one embodiment, an extra-long press held for two seconds will reset the electronic padlock. In other embodiments, the electronic padlock gives an indication of success or failure by emitting a red light and/or long beep.

In a third embodiment, an electronic locking device can provide access to a replaceable power supply. The electronic locking device can include a hole in which a small rod can be inserted (e.g., a paper clip). The rod can contact a latch mechanism that releases a latch on a battery cover of the electronic locking device. When the latch is released, the battery cover can be removed. In some embodiments, the latch is self-locking such that when the battery cover is replaced, the latch locks automatically (e.g., mechanically, electrically, etc.).

Figure 1:
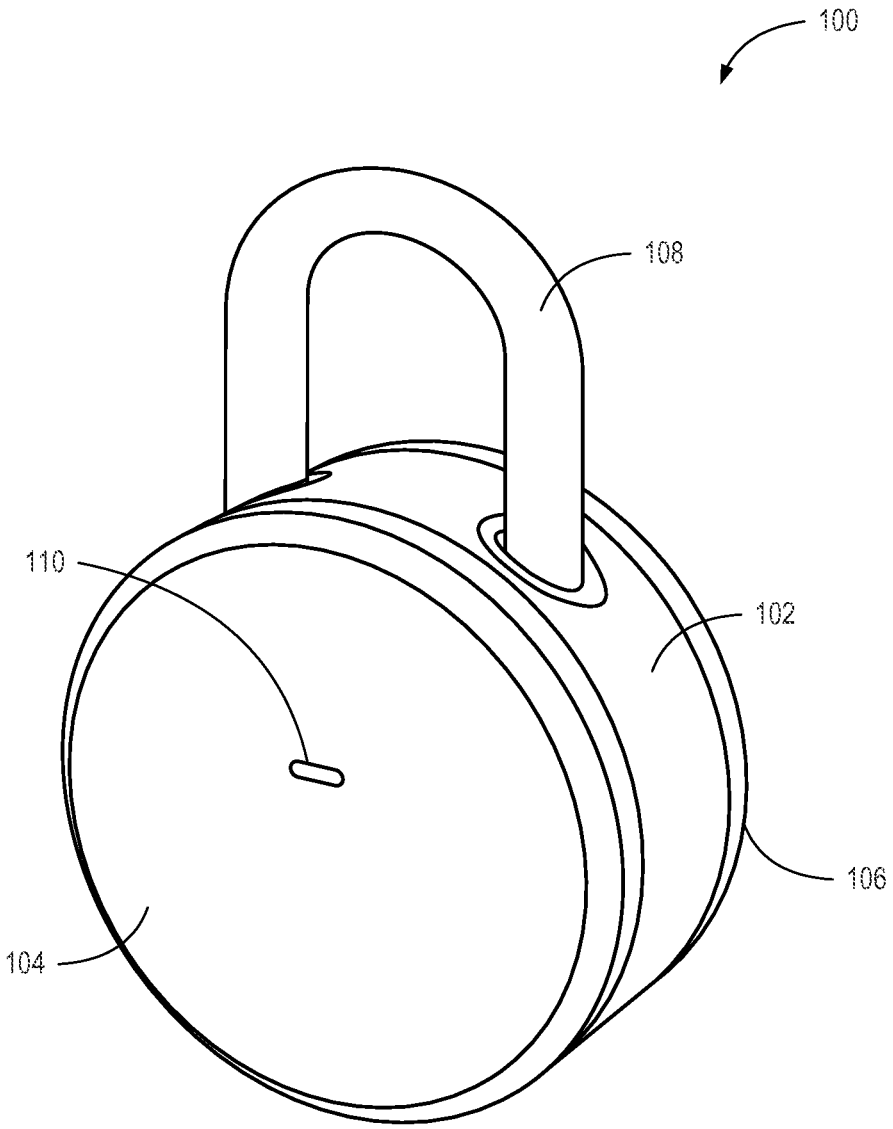
FIG. 1 is a perspective view illustrating an electronic locking device consistent with embodiments disclosed herein.

It should be recognized that an electronic locking device can be a lock. Locks can take various forms, such as a padlock as shown in FIG. 1, having a horizontal cylindrical shape. Other shapes are also possible, such as cubic shapes, trapezoid shapes, vertical cylindrical shapes, etc.

FIG. 1 is a perspective view illustrating an electronic locking device 100 consistent with embodiments disclosed herein. The electronic locking device 100 can be a padlock that includes a lock body 102, a front end cap 104, a back end cap 106, and a shank 108. An LED status light 110 can show status by displaying multiple colors, multiple blink patterns, solid lights, and/or nothing. The status light 110 can show states including waking up, going to sleep, locked, unlocked, entry type (e.g., short or long), successful password, unsuccessful password, communication speed, communication status, channel, connectivity, and/or reset.

In some embodiments, the end caps 104 and 106 can be removed. In one example, the end caps 104 and 106 can be removed when in an unlocked state, but not when in a locked state. In another example, the front end cap 104 can only be removed in an unlocked state, but the back end cap 106 can be removed to expose a removable battery (such as described above). Other combinations are also possible.

Electronics can be housed inside the lock body 102, and antennas can be built into the circuit boards and/or the external case (such as the lock body 102, the end cap 104 or 106, or the shank 108). In one embodiment, the front end cap 104 includes an antenna strip. In another embodiment, the back end cap 106 is configured to be transparent to wireless signals.

FIG. 2 shows an exploded diagram of an embodiment of the electronic locking device shown in FIG. 1. In the embodiment shown, an electronic locking device 200 can include two locking body gaskets 212, a locking body 202, a front end cap 204, a back end cap 206, a controller board 214, a motor 216, a battery board 218, a battery 220, a shank 208, two shank gaskets 222, a shank guide 224, a locking spindle 226, two ball bearings 228, a shank clip 230, a shank spring 232, four sets of screws 234 and a retaining disc 236.

The locking body gaskets 212 can provide weather protection between the locking body 202 and the end caps 204 and 206. In one embodiment, the locking body gaskets 212 are made from silicone. In an embodiment, the locking body gaskets 212 form a seal as the end caps 204 and 206 are tightened by screwing the threaded end caps 204 and 206 onto the locking body 202.

The locking body 202 can be formed to receive components of the electronic locking device 200. In some embodiments, the locking body 202 includes two chambers 238 and 240 separated by a wall to prevent tampering with the electronic locking device 200. A first chamber 238 can house a locking mechanism that can only be accessed when the electronic locking device 200 is unlocked. A second chamber 240 (not shown) can house the battery 220 such that it can be accessed even when the electronic locking device 200 lacks power (e.g., a dead battery). The front end cap 204 can attach to and cover the first chamber 238. The back end cap 206 can attach to and cover the second chamber 240. The end caps 204 and 206 can attach through various methods including threading (to screw a cap onto the locking body 202), press-fit connections (to press such that a ridge of one side connects to a valley on the other side), pins, screws, latches, etc.

The controller board 214 can house a processor 242, memory, computer-readable media, wireless interfaces, antennas 244, and other supporting electronic components of the electronic locking device 200. The controller board 214 can include a Bluetooth™ low power interface and/or a WiFi™ interface. In one embodiment, the Bluetooth™ low power interface allows communication channels to be formed with mobile devices that are authorized to unlock the electronic locking device 200. In another embodiment, the WiFi™ interface allows channels to be formed with mobile devices that are authorized to unlock the electronic locking device 200. In an embodiment, the WiFi™ interface allows connection to a locking service through an access point. A controller on the controller board can then query the service as to whether a connected mobile device is authorized to operate the electronic locking device 200 and/or grant permissions for operating the electronic locking device 200 (e.g., unlock-only, lock-only, lock/unlock, administrative access, granting permissions to other users, etc.). In some embodiments, the controller causes permissions to be stored locally on the electronic locking device 200. In other embodiments, the controller queries a locking service to determine permissions. In one embodiment, a hybrid is used such that permissions are stored locally on the electronic locking device 200 and updated from the locking service. In an embodiment, a hybrid authorization service is used such that some permissions are stored locally (e.g., unrestricted grantees) on the electronic locking device 200, while other permissions are queried from the service (e.g., restricted grantees). In another embodiment, a hybrid approach is used where the electronic locking device 200 first searches for grantee permissions locally and, if not finding them, requests permissions from the locking service. Other combinations are also possible.

It should be recognized that when a mobile device is authorized to unlock the electronic locking device 200, the authorization can be provided through several means. In one embodiment, a mobile device is "paired" (such as a Bluetooth™ pairing) such that the electronic locking device 200 can connect with a paired mobile device. Authorization to unlock is accomplished by the electronic locking device 200 verifying a presence of a paired device. In another embodiment, a pre-shared key can be used in a challenge/response scenario. Authorization can be accomplished by receiving a correct response to a challenge. The correct response causes the electronic locking device 200 to transition into an unlocked state. In yet another embodiment, an application can use a wireless interface of a mobile device to communicate with a service. Upon verifying credentials (such as a token) of the mobile device and/or position of the mobile device (such as GPS location and/or a beacon received from the electronic locking device 200), the service can provide authorization for the electronic locking device 200 to unlock.

The battery board 218 can reside in the second chamber 240 of the locking body 202 and can provide connectivity and information about the battery 220. In one embodiment, the battery board 218 determines remaining battery life and notifies the controller of any problems. In an embodiment and if problems are detected, the battery board 218 can report the problems to a controller on the controller board 214. The controller can communicate with the locking service over a WiFi™ communications channel and transmit a message describing the problem. The locking service can then communicate the problem to a user, such as through a text message, an application notification, a phone call, an email, etc. The battery board 218 can receive a battery 220 and be covered by an back end cap 206.

The shank 208 can be used as part of a locking mechanism of the electronic locking device 200. The shank 208 can be received by the locking body 202. The shank 208 can have horizontal movement (e.g., play) reduced by the shank guide 224. The shank gaskets 222 can be added to reduce play and aid in weatherproofing the locking body 202 at shank entrances. The shank guide 224 can also help contain the locking spindle 226 within the locking body 202. The locking spindle 226 can include raised and recessed portions that move the ball bearings 228 outward from its axis. The locking spindle 226 can be controllably turned by the motor 216, controlled by the processor 242 on the controller board 214. When turned at a first angle relative to the locking body 202, the locking spindle 226 can be in a locking state. When in a locking state, the locking spindle 226 can cause the ball bearings 228 to be pushed within recesses of the shank 208. When the ball bearings 228 are present within the recesses of the shank 208, the shank 208 is prevented from moving out of a locked position (e.g., vertically) within the locking body 202. When turned at a second angle relative to the locking body 202, the locking spindle 226 can be in an unlocked state. When in an unlocked state, the ball bearings 228 can be pushed into the recesses of the locking spindle 226, and the shank 208 can move (e.g., vertically). The shank clip 230 may be attached to a longer end of the shank 208 to prevent the shank 208 from exiting the locking body 202. The shank spring 232 can provide vertical lift when transitioning to an unlocked state and/or resistance to locking when transitioning to a locked state. The retaining disc 236 can be placed over the locking body 202 to enclose moving parts within the locking body 202 and provide support to the moving parts (e.g., the ball bearings 228, etc.).

Various fastening technologies can be used to hold together the electronic locking device 200. In the embodiment shown, the four sets of screws 234 are used to fasten circuit boards to the locking body 202. The end caps 204 and 206 include threads that screw onto the locking body 202. However, it should be recognized that other fastening systems and/or devices can also be used.

Figure 3:
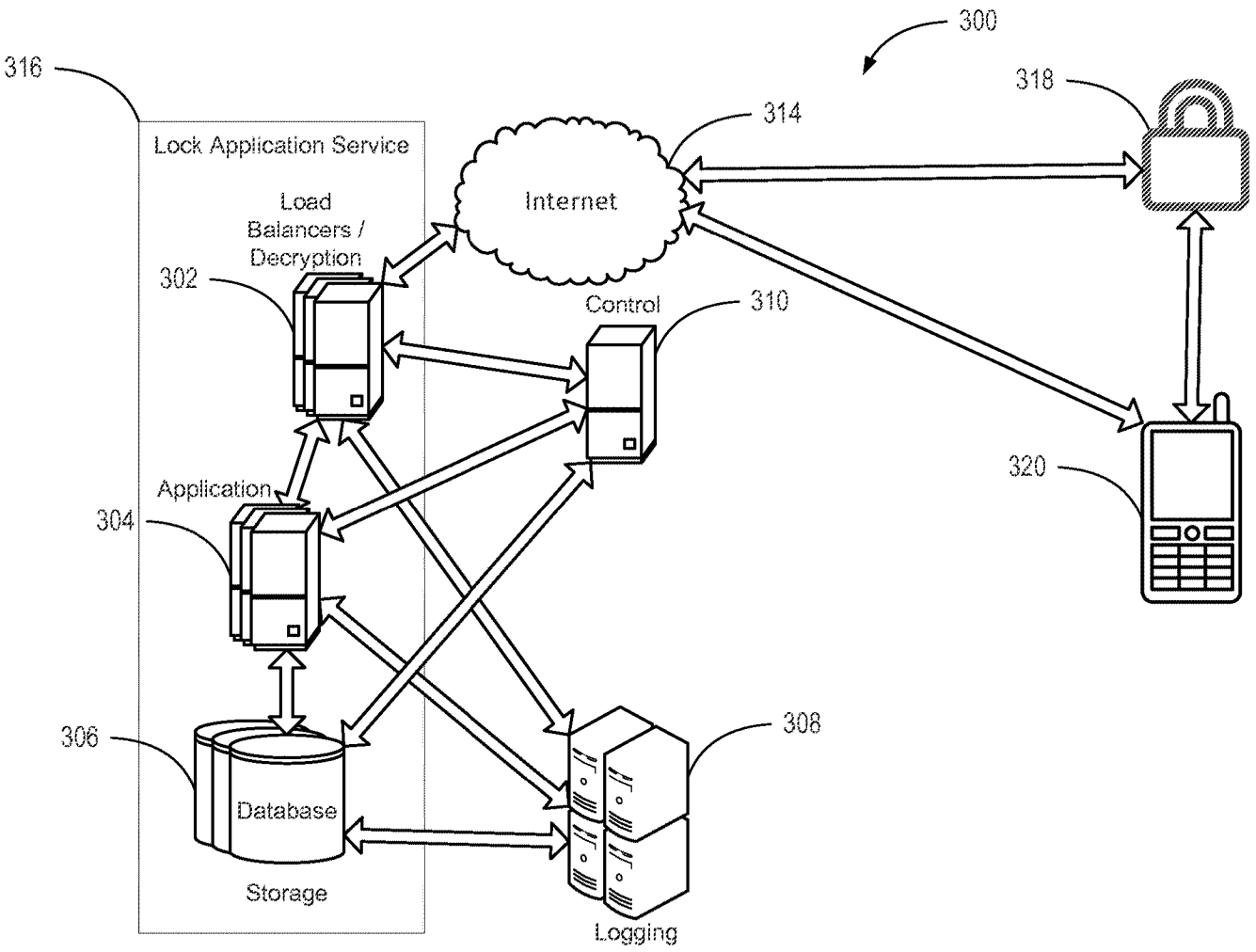
FIG. 3 is a system diagram illustrating a system configured to provide services to the electronic locking device of FIG. 1 consistent with embodiments disclosed herein.

FIG. 3 is a system diagram illustrating a system 300 configured to provide services to the electronic locking device of FIG. 1 consistent with embodiments disclosed herein. An electronic lock 318 can communicate with a mobile device 320 and/or a lock application service 316 (also known as a locking service) over an Internet 314 as described above. The lock application service 316 can include load balancers 302 capable of decryption, application servers 304, storage 306, control servers 310, and/or a logging service 308 (which can include one or more logging servers).

In one example, a user can set up an account with the lock application service 316 using an application on the mobile device 320. The user registers the electronic lock 318 with the lock application service 316. The lock application service 316 can store user credentials in storage 306 and associate the user credentials with an electronic lock identifier for the electronic lock 318.

The user can then invite other users to join the lock application service 316 and grant joined users permissions to the electronic lock 318. Permissions can be restricted to days, times, number of times unlocking is granted, a period of time, a repeating schedule, and/or other restrictions on timing and use of the electronic lock 318. Permissions can be stored in storage 306.

Depending on the embodiment, permissions can be stored locally on the electronic lock 318 and/or in the lock application service 316. For example, when permissions are stored solely by the lock application service 316, the electronic lock 318 can be transitioned to an awake state by a user interaction and connect to the mobile device 320 over Bluetooth™. The mobile device 320 can transmit credentials to the electronic lock 318. The electronic lock 318 can send the credentials (or a message based on the credentials, e.g., a cryptographic hash) to the lock application service 316 for determination of whether the mobile device 320 is authorized to unlock the electronic lock 318. The lock application service 316 can transmit a message indicating authorization or failure to the electronic lock 318 and log the attempt in the logging service 308. If authorization is successful, the electronic lock 318 can transition to an unlocked state and release the locking mechanism. If authorization is not successful, the electronic lock 318 can stay in the same state and provide an indicator of the failure (e.g., light, sound, etc.).

In another example, when permissions are stored solely by the electronic lock 318, the electronic lock 318 can be transitioned to an awake state by a user interaction and connect to the mobile device 320 over Bluetooth™. The mobile device 320 can transmit credentials to the electronic lock 318. The electronic lock 318 can determine whether the credentials match credentials available locally to the electronic lock 318. If a match is found and the user is authorized, the electronic lock 318 can transition to an unlocked state and release the locking mechanism. If the user is not authorized, the electronic lock 318 can stay in the same state and provide an indicator of the failure (e.g., light, sound, etc.).

In one example, when permissions are stored by the electronic lock 318 and the lock application service 316, the electronic lock 318 can be transitioned to an awake state by a user interaction and connect to the mobile device 320 over Bluetooth™. The mobile device 320 can transmit credentials to the electronic lock 318. The electronic lock 318 can determine whether the credentials match credentials available locally to the electronic lock 318. If a match is found and the user is authorized, the electronic lock 318 can transition to an unlocked state and release the locking mechanism. If no match is found, the electronic lock 318 can send the credentials (or a message based on the credentials, e.g., a cryptographic hash) to the lock application service 316 for determination of whether the mobile device 320 is authorized to unlock the electronic lock 318. The lock application service 316 can transmit a message indicating authorization or failure to the electronic lock 318 and log the attempt in the logging service 308. If authorization is successful, the electronic lock 318 can transition to an unlocked state and release the locking mechanism. If authorization is not successful, the electronic lock 318 can stay in the same state and provide an indicator of the failure (e.g., light, sound, etc.).

In an example, the electronic lock 318 can transition to an awake state in response to a user interaction (such as pressing on the shank). The electronic lock 318 can transmit a beacon over a first communication channel (such as Bluetooth™). The mobile device 320 can receive the beacon and transmit proof of receipt of the beacon (or a message based on the beacon, e.g., a cryptographic hash) to the lock application service 316 over a second communication channel (e.g., WiFi™). The lock application service 316 can determine whether the mobile device 320 is authorized to unlock the electronic lock 318. The lock application service 316 can transmit a message indicating authorization, if successful, to the electronic lock 318 over the second communication channel (e.g., WiFi™) and log the attempt in the logging service 308. When an authorization message is received, the electronic lock 318 can transition to an unlocked state and release the locking mechanism. If authorization is not successful, the electronic lock 318 can stay in the same state, and an application on the mobile device 320 can provide an indicator of the failure (e.g., light, sound, message, etc.). In some embodiments, the beacon can be transmitted over the second communication channel and only one communication channel is used.

Logged history can be made available to a user of the electronic lock 318 (e.g., an owner, administrator, authorized user, etc.). History can include various events, attempts, and permissions related to the electronic lock 318. This can include current status of the electronic lock 318 (locked, unlocked, battery power, etc.), prior status of the electronic lock 318, user requests received, failed attempts, successful attempts, network connectivity issues, last updates, updated permissions, and/or other interactions with the electronic lock 318 or the lock application service 316.

Figure 4:
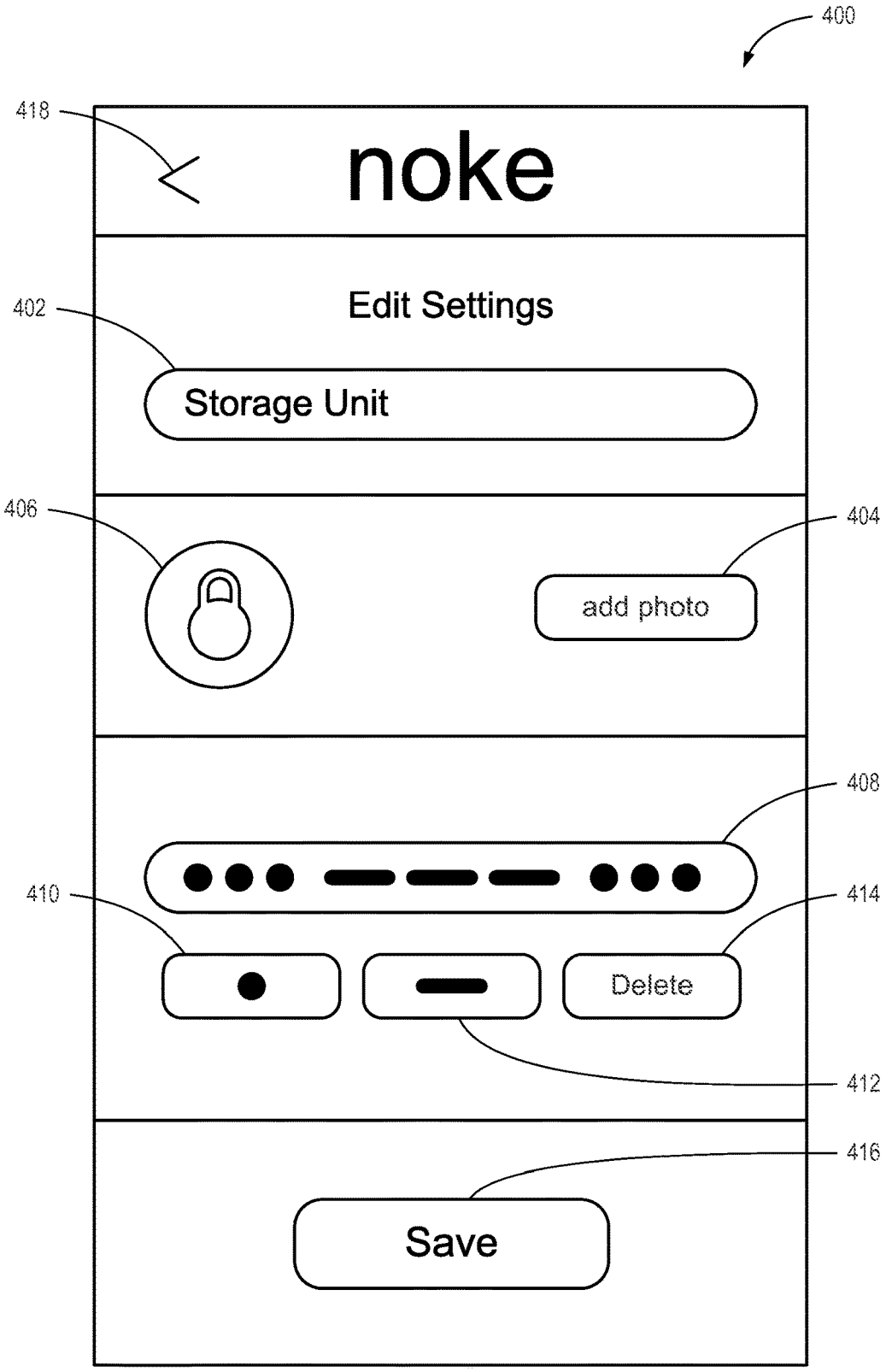
FIG. 4 is an illustration of a user interface for configuring a secondary unlocking interaction consistent with embodiments disclosed herein.

FIG. 4 is an illustration of a user interface 400 for configuring a secondary unlocking interaction consistent with embodiments disclosed herein. A user can access an application on a mobile device. In some embodiments, the application can verify user credentials with a locking service before access is allowed. In other embodiments, an electronic lock can operate without a locking service, and a direct connection with the lock is established through a setup procedure (e.g., using an initial set of physical interactions to access the device).

The application can enable a user to alter settings of an electronic lock using the user interface 400 as shown in FIG. 4. A user can alter a name of the lock, provide a photograph of the lock, and set a series of physical interactions that will unlock the lock. In the embodiment shown, a user can type a new name in a name field 402. A picture can be added by clicking an add photo button 404 and then taking a new photo or selecting an existing photo (such as a photo stored on the mobile device). Added pictures can then be displayed in a photo area 406. The series of physical interactions can be displayed in an interaction settings field 408. The series can be edited by using buttons below the interaction settings field 408 (such as an insert short interaction button 410, an insert long interaction button 412, and a delete button 414). A save button 416 can cause settings displayed on the screen to be stored and used in device and/or service configurations. A navigation button 418 (such as a back button) can aid in moving between user interfaces (or screens of a user interface).

In some embodiments, physical interaction can be used as a backup when an authorized mobile device is lost or unavailable. For example, a user can set a series of three dots (e.g., short pushes), three dashes (e.g., three long pushes), and three dots, and click on the save button 416. When a mobile device is unavailable, the user can push on the shank of the lock using the series entered previously to open the lock (e.g., three clicks, three holds, and three clicks). This interaction can allow the lock to open.

In some embodiments, the lock can transition temporarily to credential-free operation when the series is correctly entered. A user can access settings (such as the user interface 400 in FIG. 4) or add devices within a time threshold after the lock is opened using the physical interaction method. In an embodiment, the series of physical interactions can be used to reset the lock to a default state. In some embodiments, a user can connect to the locking service to request authorization, successfully perform the series of physical interactions, and then receive access to the electronic lock (as the electronic lock can report the successful interaction to the locking service).

Figure 5:
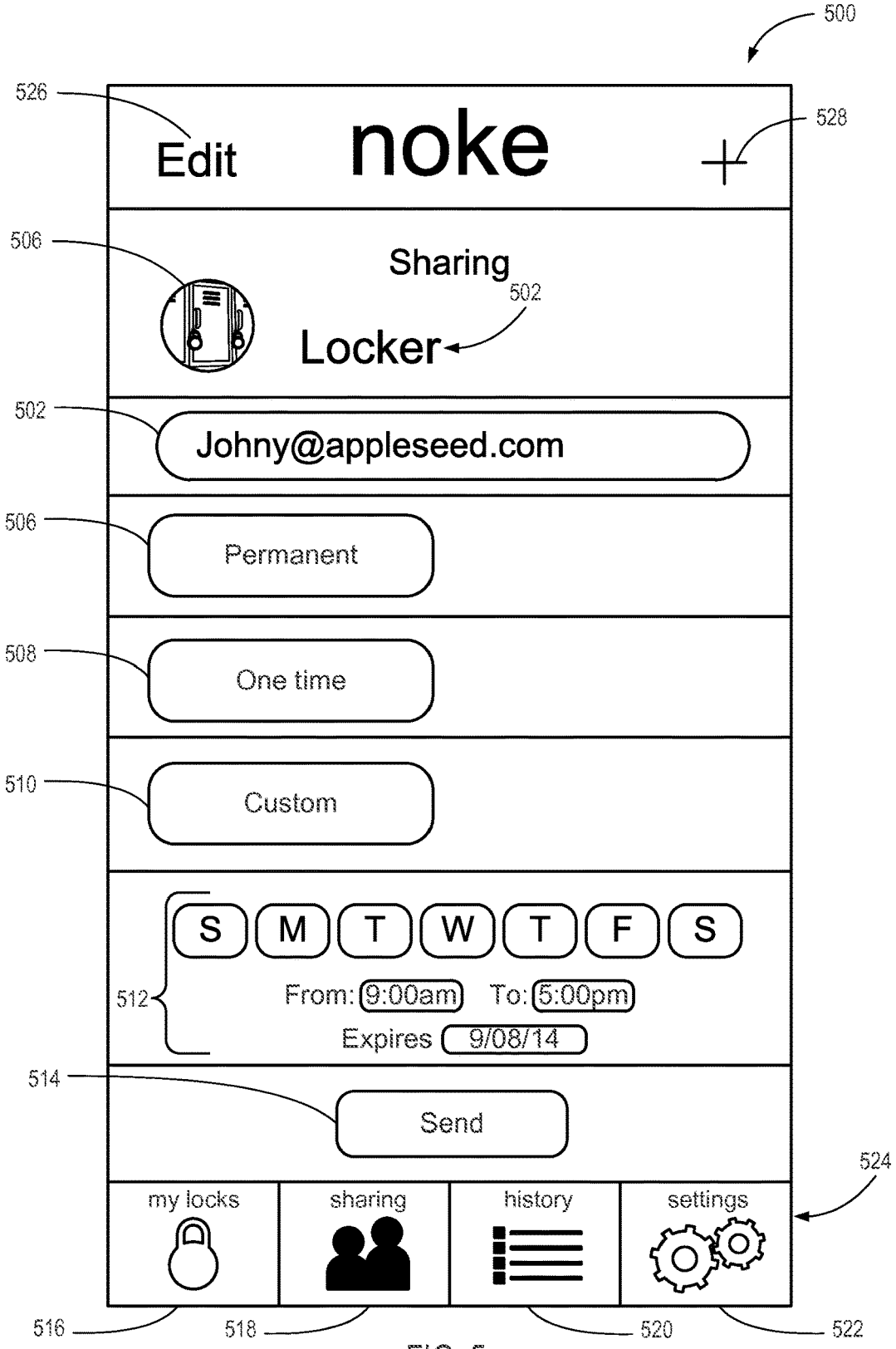
FIG. 5 is an illustration of a user interface for authorizing a user to unlock an electronic locking device consistent with embodiments disclosed herein.

FIG. 5 is an illustration of a user interface for authorizing a user to unlock an electronic locking device consistent with embodiments disclosed herein. In an embodiment, the user can access a settings screen 500 that allows an administrative user to define permissions for an authorized user (and/or invite a new user to accept permissions to the lock). A lock can be identified in a title location 502 and a picture location 506. An authorized user can be identified by a user identifier 504 (such as an email, login, name, etc.). Permissions can be tailored to the user. Permissions can be set for permanent or single use, or further refined by days, times, and/or an expiration date. Permissions can be entered by clicking a permanent button 506, a one time button 508, or a custom button 510. In the embodiment shown, the custom button 510 can be used to enable a date selection input area 512 in which days of weeks, times and/or an expiration date can be entered. Once the permissions have been entered, the user can activate the send button 514 to send an authorization or invitation to share access to the lock.

In some embodiments, the settings screen 500 can include an edit button 526 to enable editing of a current lock. In one embodiment, an add button or plus button 528 can be used to add an additional lock (e.g., pair a lock) to the application and/or mobile device. In some embodiments, this authorization is sent by email to a user, inviting the user to accept the permissions, download a mobile application, and/or create an account with the service.

Other user interface screens can include a list of locks, a history of interactions with the locks and/or service, lock settings, and/or application settings. These screens can be accessed by a menu row 524, including buttons 516, 518, 520 and 522.

Figure 6:
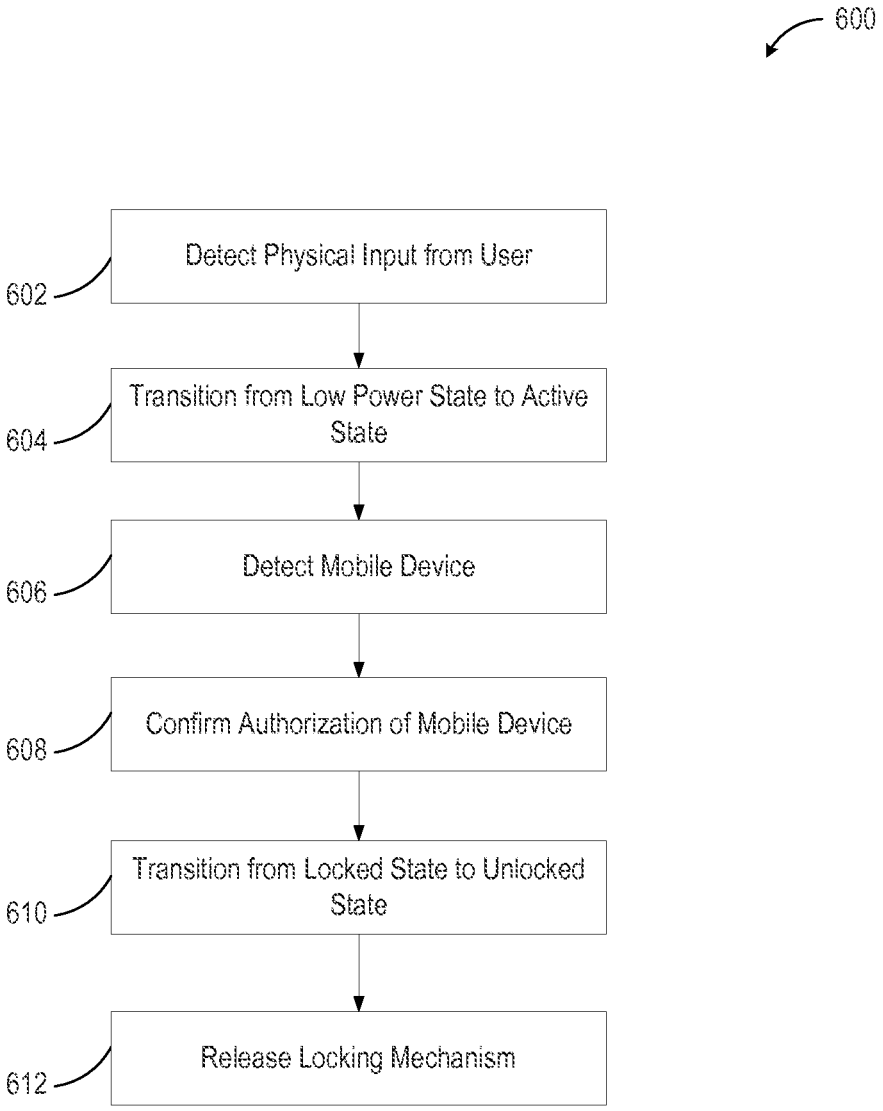
FIG. 6 is a flow chart illustrating a method for unlocking an electronic lock consistent with embodiments disclosed herein.

FIG. 6 is a flow chart illustrating a method 600 for unlocking an electronic lock consistent with embodiments disclosed herein. The method 600 can be accomplished by the system 300 shown in FIG. 3, including the electronic lock 318, the mobile device 320, and the lock application service 316. In box 602, the lock detects physical input from a user. In box 604, the physical input causes the lock to transition from a low power state to an active state. In box 606, the lock can detect a mobile device (such as through a mobile device responding to a beacon transmitted over a wireless channel). In box 608, the lock can confirm authorization of the mobile device to perform an action on the lock (e.g., open request). The authorization can be based on direct communication with the mobile device or communication through an intermediary (such as a locking service). In box 610, upon successful confirmation of the authorization, the lock can transition from a locked state to an unlocked state. In box 612, the lock can release a locking mechanism.

In some embodiments the operation in boxes 606-608 can be performed by a locking service. For example, the mobile device can send a message to a locking service that identifies a wireless beacon received by the mobile device and credentials of a user of the device. The receipt of the beacon can prove the mobile device is within the physical proximity of the lock. The locking service can confirm the authorization of the user to access the lock and transmit a message to the lock to cause the lock to transition from a locked state to an unlocked state.

In some embodiments, the active state is still a lower power state than when operating a lock. Lock operation components (and/or other components, such as wireless components) can be selectively deactivated when not needed.

Figure 7:
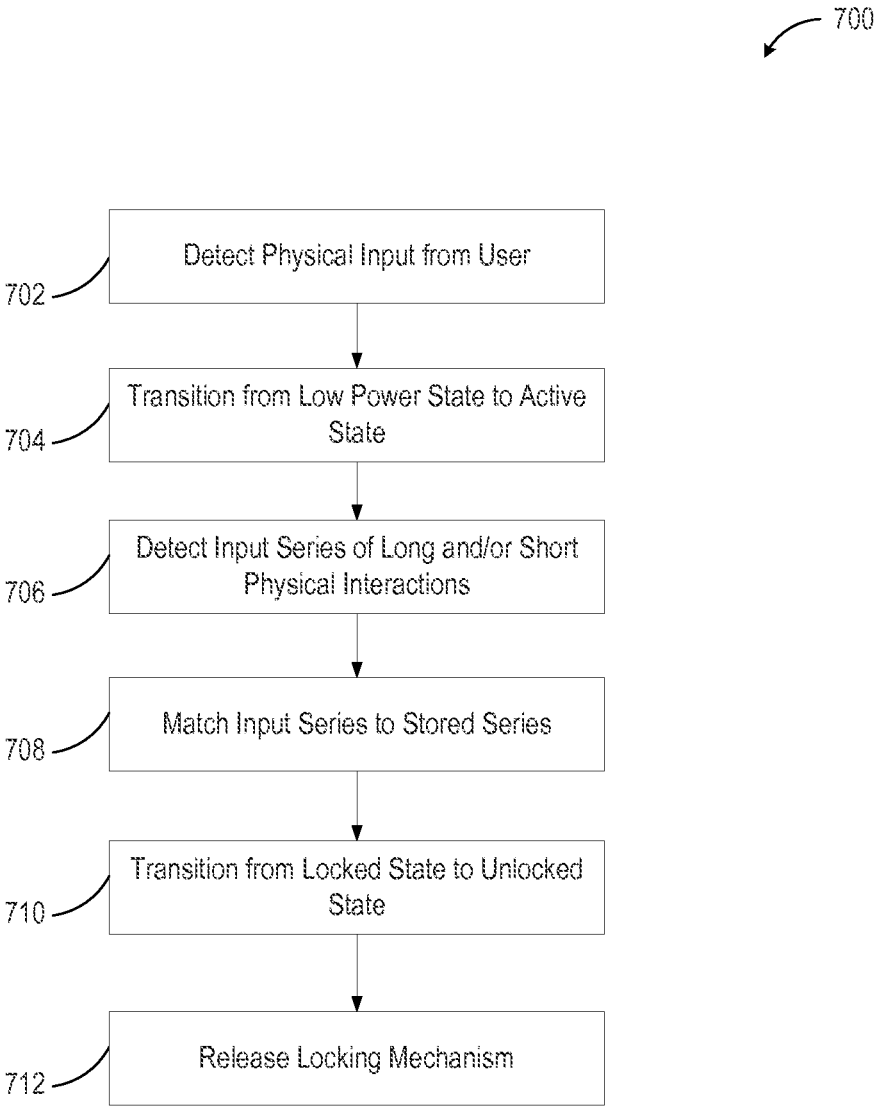
FIG. 7 is a flow chart illustrating an alternative method for unlocking an electronic lock consistent with embodiments disclosed herein.

FIG. 7 is a flow chart illustrating an alternative method 700 for unlocking an electronic lock consistent with embodiments disclosed herein. The method 700 can be accomplished by the system 300 shown in FIG. 3, including the electronic lock 318, the mobile device 320, and the lock application service 316. In box 702, the lock can detect physical input from a user. In box 704 and in response to the physical input, the lock can transition from a low power state to an active state. In box 706, the lock can detect an input series of long and/or short physical interactions with the device (e.g., long clicks with short clicks, long touches with short touches, longer duration shakes and shorter duration shakes, etc.). In one embodiment, a long duration interaction can last half a second or longer, and a short duration interaction can be for less than half a second. In another embodiment, a long duration interaction can last more than one second, and a short duration interaction can be for one second or less. In box 708, the input series can be matched against a stored series that was configured prior to the input series. In box 710 and when the input series matches the stored series, the lock can transition from a locked state to an unlocked state. In box 712, the lock can release a locking mechanism allowing a physical unlocking of the lock from a captured object (e.g., hatch, latch, cable, etc.).

It should be recognized that the electronic lock 318 can be operated with or without the lock application service 316. When operating without the lock application service 316, the lock or application on a mobile device can provide locking services (such as emailing authorization keys, peer-to-peer transfer of authorization keys, etc.). Verification of authorization can be performed onboard the lock by the processor.

Figure 8:
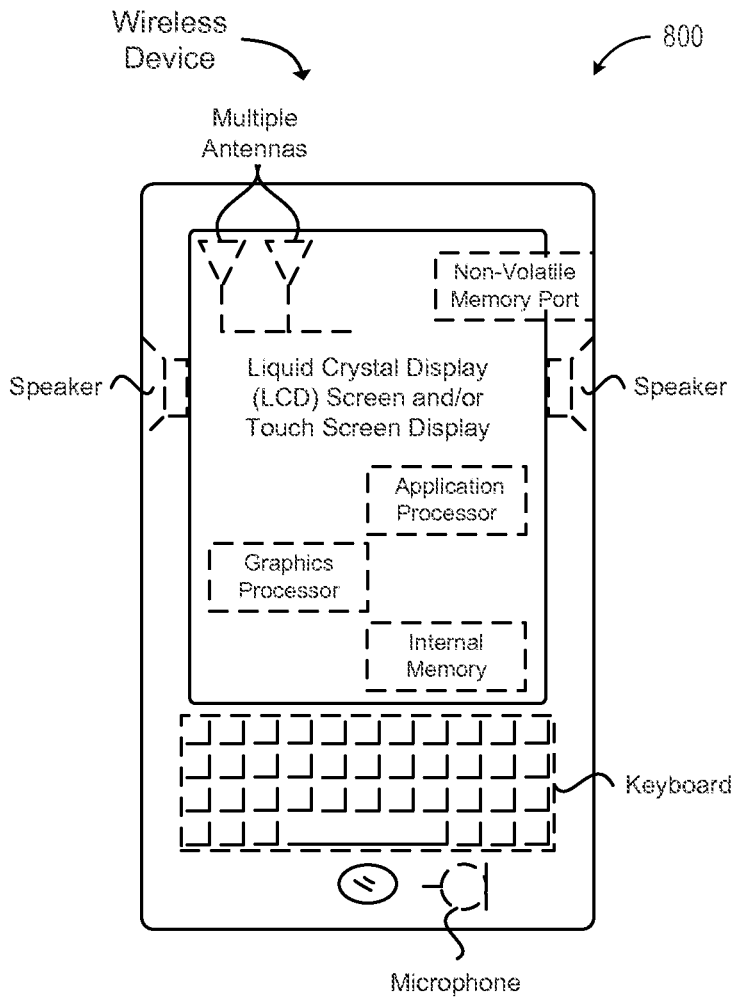
FIG. 8 is a diagram of a mobile device consistent with embodiments disclosed herein.

FIG. 8 is a diagram of a mobile device 800 consistent with embodiments disclosed herein. The mobile device 800 can include multiple antennas, a speaker, a non-volatile memory port, a keyboard (electronic or physical), a microphone, a display (such as an LCD screen), a touch screen, an application processor, a graphics processor, and internal memory. The mobile device 800 can connect to one or more wireless services through wireless protocols such as LTE™ by the third generation partnership project (3GPP)™, WiFi™ as defined by IEEE 802.11 standards, Bluetooth™ by Bluetooth SIG, Inc. (including Bluetooth™ 4.0/Bluetooth™ Low Power), etc. The mobile device 800 can process instructions on its application processor and graphics processor using internal memory and render one or more user interfaces (which can include one or more screens) to the display.

Figure 9:
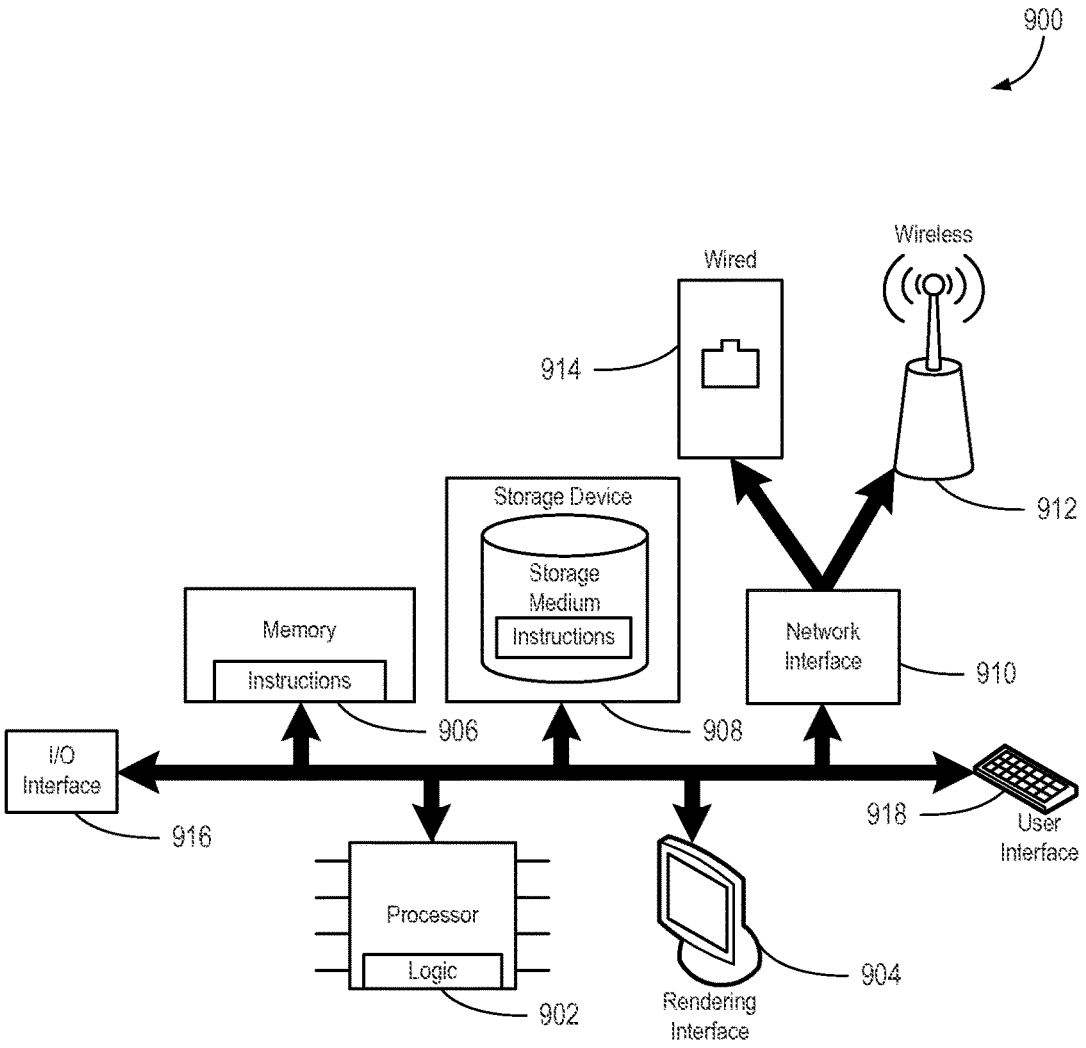
FIG. 9 is a schematic diagram of a computing system consistent with embodiments disclosed herein.

FIG. 9 is a schematic diagram of a computing system 900 consistent with embodiments disclosed herein. The computing system 900 can be viewed as an information passing bus that connects various components. In the embodiment shown, the computing system 900 includes a processor 902 having logic for processing instructions. Instructions can be stored in and/or retrieved from memory 906 and a storage device 908 that includes a computer-readable storage medium. Instructions and/or data can arrive from a network interface 910 that can include wired 914 or wireless 912 capabilities. Instructions and/or data can also come from an I/O interface 916 that can include such things as expansion cards, secondary buses (e.g., USB, etc.), devices, etc. A user can interact with the computing system 900 though a user interface device 918 and a rendering interface 904 that allows the computer to receive and provide feedback to the user.

Embodiments and implementations of the systems and methods described herein may include various operations, which may be embodied in machine-executable instructions to be executed by a computer system. A computer system may include one or more general-purpose or special-purpose computers (or other electronic devices). The computer system may include hardware components that include specific logic for performing the operations or may include a combination of hardware, software, and/or firmware.

Computer systems and the computers in a computer system may be connected via a network. Suitable networks for configuration and/or use as described herein include one or more local area networks, wide area networks, metropolitan area networks, and/or Internet or IP networks, such as the World Wide Web, a private Internet, a secure Internet, a value-added network, a virtual private network, an extranet, an intranet, or even stand-alone machines that communicate with other machines by physical transport of media. In particular, a suitable network may be formed from parts or entireties of two or more other networks, including networks using disparate hardware and network communication technologies.

One suitable network includes a server and one or more clients; other suitable networks may contain other combinations of servers, clients, and/or peer-to-peer nodes, and a given computer system may function both as a client and as a server. Each network includes at least two computers or computer systems, such as the server and/or clients. A computer system may include a workstation, laptop computer, disconnectable mobile computer, server, mainframe, cluster, so-called "network computer" or "thin client," tablet, smartphone, personal digital assistant or other hand-held computing device, "smart" consumer electronics device or appliance, medical device, or a combination thereof.

Suitable networks may include communications or networking software, such as the software available from Novell®, Microsoft®, and other vendors, and may operate using TCP/IP, SPX, IPX, and other protocols over twisted pair, coaxial, or optical fiber cables; telephone lines; radio waves; satellites; microwave relays; modulated AC power lines; physical media transfer; and/or other data transmission "wires" known to those of skill in the art. The network may encompass smaller networks and/or be connectable to other networks through a gateway or similar mechanism.

Various techniques, or certain aspects or portions thereof, may take the form of program code (i.e., instructions) embodied in tangible media, such as floppy diskettes, CD-ROMs, hard drives, magnetic or optical cards, solid-state memory devices, a nontransitory computer-readable storage medium, or any other machine-readable storage medium wherein, when the program code is loaded into and executed by a machine, such as a computer, the machine becomes an apparatus for practicing the various techniques. In the case of program code execution on programmable computers, the computing device may include a processor, a storage medium readable by the processor (including volatile and nonvolatile memory and/or storage elements), at least one input device, and at least one output device. The volatile and nonvolatile memory and/or storage elements may be a RAM, an EPROM, a flash drive, an optical drive, a magnetic hard drive, or other medium for storing electronic data. One or more programs that may implement or utilize the various techniques described herein may use an application programming interface (API), reusable controls, and the like. Such programs may be implemented in a high-level procedural or an object-oriented programming language to communicate with a computer system. However, the program(s) may be implemented in assembly or machine language, if desired. In any case, the language may be a compiled or interpreted language, and combined with hardware implementations.

Each computer system includes one or more processors and/or memory; computer systems may also include various input devices and/or output devices. The processor may include a general-purpose device, such as an Intel®, AMD®, or other "off-the-shelf" microprocessor. The processor may include a special-purpose processing device, such as ASIC, SoC, SiP, FPGA, PAL, PLA, FPLA, PLD, or other customized or programmable device. The memory may include static RAM, dynamic RAM, flash memory, one or more flip-flops, ROM, CD-ROM, DVD, disk, tape, or magnetic, optical, or other computer storage medium. The input device(s) may include a keyboard, mouse, touch screen, light pen, tablet, microphone, sensor, or other hardware with accompanying firmware and/or software. The output device(s) may include a monitor or other display, printer, speech or text synthesizer, switch, signal line, or other hardware with accompanying firmware and/or software.

It should be understood that many of the functional units described in this specification may be implemented as one or more components, which is a term used to more particularly emphasize their implementation independence. For example, a component may be implemented as a hardware circuit comprising custom very large scale integration (VLSI) circuits or gate arrays, or off-the-shelf semiconductors such as logic chips, transistors, or other discrete components. A component may also be implemented in programmable hardware devices such as field programmable gate arrays, programmable array logic, programmable logic devices, or the like.

Components may also be implemented in software for execution by various types of processors. An identified component of executable code may, for instance, comprise one or more physical or logical blocks of computer instructions, which may, for instance, be organized as an object, a procedure, or a function. Nevertheless, the executables of an identified component need not be physically located together, but may comprise disparate instructions stored in different locations that, when joined logically together, comprise the component and achieve the stated purpose for the component.

Indeed, a component of executable code may be a single instruction, or many instructions, and may even be distributed over several different code segments, among different programs, and across several memory devices. Similarly, operational data may be identified and illustrated herein within components, and may be embodied in any suitable form and organized within any suitable type of data structure. The operational data may be collected as a single data set, or may be distributed over different locations including over different storage devices, and may exist, at least partially, merely as electronic signals on a system or network. The components may be passive or active, including agents operable to perform desired functions.

Several aspects of the embodiments described will be illustrated as software modules or components. As used herein, a software module or component may include any type of computer instruction or computer-executable code located within a memory device. A software module may, for instance, include one or more physical or logical blocks of computer instructions, which may be organized as a routine, program, object, component, data structure, etc., that perform one or more tasks or implement particular data types. It is appreciated that a software module may be implemented in hardware and/or firmware instead of or in addition to software. One or more of the functional modules described herein may be separated into sub-modules and/or combined into a single or smaller number of modules.

In certain embodiments, a particular software module may include disparate instructions stored in different locations of a memory device, different memory devices, or different computers, which together implement the described functionality of the module. Indeed, a module may include a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices. In addition, data being tied or rendered together in a database record may be resident in the same memory device, or across several memory devices, and may be linked together in fields of a record in a database across a network.

Reference throughout this specification to "an example" means that a particular feature, structure, or characteristic described in connection with the example is included in at least one embodiment of the present invention. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of materials, frequencies, sizes, lengths, widths, shapes, etc., to provide a thorough understanding of embodiments of the invention. One skilled in the relevant art will recognize, however, that the invention may be practiced without one or more of the specific details, or with other methods, components, materials, etc. In other instances, well-known structures, materials, or operations are not shown or described in detail to avoid obscuring aspects of the invention.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive, and the invention is not to be limited to the details given herein, but may be modified within the scope and equivalents of the appended claims.

Those having skill in the art will appreciate that many changes may be made to the details of the above-described embodiments without departing from the underlying principles of the invention. The scope of the present invention should, therefore, be determined only by the following claims.

The invention claimed is:

1. An electronic lock, comprising:

a lock body;

a locking mechanism to transition between a locked state and an unlocked state;

a touch sensor to detect touch input interactions of varying durations from an operator;

a digital storage medium to store an unlock code, the unlock code comprising a series of touch input interactions of at least two different durations;

a controller to:

detect a series of touch input interactions of varying durations via the touch sensor, compare the durations of the detected series of touch input interactions with those in the stored unlock code, and transition the locking mechanism from the locked state to the unlocked state based on a determination that the durations of the touch input interactions in the detected series of touch input interactions match those in the stored unlock code; and a status light to indicate whether each touch input interaction of the detected series of touch input interactions was detected as a long duration touch input interaction or a short duration touch input interaction during its respective detected duration.

2. The electronic lock of claim 1, wherein the electronic lock comprises a U-lock padlock.

3. The electronic lock of claim 1, further comprising a power supply module configured to remain in a low power state until a first touch input interaction is detected via the touch sensor.

4. The electronic lock of claim 1, wherein the touch sensor comprises one of: a light-based touch sensor, a capacitive touch sensor, and a resistive touch sensor.

5. The electronic lock of claim 1, wherein each touch input interaction in the stored unlock code comprises one of a short duration touch input interaction and a long duration touch input interaction.

* * * * *